US007780067B2

(12) United States Patent
Holley, Jr.

(10) Patent No.: US 7,780,067 B2
(45) Date of Patent: Aug. 24, 2010

(54) CARTON WITH REINFORCED HANDLE OPENINGS

(75) Inventor: John M. Holley, Jr., Lawrenceville, GA (US)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 539 days.

(21) Appl. No.: 11/537,642

(22) Filed: Sep. 30, 2006

(65) Prior Publication Data

US 2008/0203143 A1 Aug. 28, 2008

Related U.S. Application Data

(63) Continuation-in-part of application No. 11/469,262, filed on Aug. 31, 2006, now abandoned.

(51) Int. Cl.
*B65D 5/462* (2006.01)

(52) U.S. Cl. ..... 229/117.16; 229/117.12

(58) Field of Classification Search ..... 229/117.16, 229/117.09, 117.12, 117.15, 117.17, 117.08
See application file for complete search history.

(56) References Cited

U.S. PATENT DOCUMENTS

| | | | | |
|---|---|---|---|---|
| 2,122,654 | A | 7/1938 | Nicherson | |
| 2,196,502 | A | 4/1940 | Kells | |
| 2,702,155 | A | 2/1955 | Baumann | |
| 3,203,613 | A | 8/1965 | Stowe | |
| 3,756,499 | A * | 9/1973 | Giebel et al. | 229/117.17 |
| 3,933,300 | A | 1/1976 | Dempster | |
| 4,046,309 | A | 9/1977 | Poggiali | |
| 4,482,090 | A | 11/1984 | Milliens | |
| 5,072,876 | A | 12/1991 | Wilson | |
| 5,350,109 | A | 9/1994 | Brown et al. | |
| 6,085,969 | A | 7/2000 | Burgoyne | |
| 6,250,542 | B1 | 6/2001 | Negelen | |
| 6,968,992 | B2 | 11/2005 | Schuster | |
| 2005/0087592 | A1 | 4/2005 | Schuster | |
| 2006/0278689 | A1 * | 12/2006 | Boshinski et al. | 229/117.16 |

FOREIGN PATENT DOCUMENTS

| | | | |
|---|---|---|---|
| GB | 2324293 | A | 10/1998 |
| WO | WO 02/22450 | A2 | 3/2002 |

* cited by examiner

*Primary Examiner*—Nathan J Newhouse
*Assistant Examiner*—Christopher Demeree
(74) *Attorney, Agent, or Firm*—MWV Intellectual Property Group

(57) ABSTRACT

A carton, having reinforced handle openings which define handles, includes a tubular structure that is formed from multiple walls. An edge flap connects two of the walls. The carton also includes end closures at each open end of the tubular structure. The end closures each include end flaps that have features that define the handles. The end closures also include edge flap reinforcing panels that are hingedly connected to the edge flap and further define the handle. Specifically, a reinforcing edge of the edge flap reinforcing panel is disposed in reinforcing proximity to a handle opening so as to reinforce at least a weight bearing edge of the handle opening to define a handle with a multi-ply thick weight bearing edge.

19 Claims, 8 Drawing Sheets

CARTON WITH REINFORCED HANDLE OPENINGS

CROSS REFERENCE TO RELATED APPLICATION

This application is a continuation-in-part of U.S. application Ser. No. 11/469,262, filed Aug. 31, 2006 now abandoned.

TECHNICAL FIELD

This invention relates generally to cartons, and particularly to a carton having a reinforced handle opening.

BACKGROUND OF THE INVENTION

Carton manufacturers often face the challenge of providing a carton with handles that are sufficiently strong to support the weight of a group of articles while minimizing material costs. In many instances, the desired thickness of the material that is used to form the carton has a burst strength that is insufficient to avoid failure of the handle under the stress caused by the weight of the articles.

One approach to resolving this quandary is to construct the carton from a stronger material such as corrugated board or from a sheet of material of a relatively higher caliper. As fully enclosed cartons typically have six walls (top, sides, bottom, and ends) that are formed from a single sheet of material, and cost tends to increase according to the strength and thickness of material used to construct the carton walls, this approach is an expensive one because it effectively amounts to reinforcing all of the walls of the carton irrespective of the relative magnitude of the forces borne by each wall.

According to another approach, additional material is applied to or around the handle opening as needed to reinforce the handle as well as the portion of the wall surrounding the handle opening. For instance, a handle opening in a carton end wall may be reinforced by outlining its edges with an additional layer of sheet material. However, it is advantageous from a manufacturing point of view to form a carton from a single sheet of material rather than to attach additional components to a carton or carton blank.

Cartons are sometimes formed from a blank that includes side end flaps and top end flaps that at least partially define an end closure. The top end flap includes a handle opening and the side end flaps include cutouts such that the side end flaps reinforce the handle opening, as known in the art. In addition, another layer of reinforcement is provided by side flap reinforcing panels which are hingedly connected to the side end flaps. Specifically, the side flap reinforcing panels are foldable to overlap at least a portion of the side end flaps adjacent to the cutouts. However, such a blank requires special folding and gluing steps and is thereby more difficult and costly to manufacture.

What is needed is a carton that is formed from a single blank, provides a reinforced handle opening, is efficiently constructed without wasting expensive material to reinforce portions of the carton that are less likely to fail, and is easily erected.

SUMMARY OF THE INVENTION

The various embodiments of the present invention overcome the shortcomings of the prior art by providing a carton formed from a single sheet of paperboard or other foldable sheet material. The carton includes a handle disposed in an end closure, wherein at least a part of the weight bearing portion of the periphery of the handle opening which defines the handle is reinforced by at least one reinforcing panel. At least the first reinforcing panel is, advantageously, connected to an edge flap which holds the carton together. Additional reinforcing panels can be hingedly connected to the first reinforcing panel or further to the edge flap. The addition of edge flap reinforcing panels provides multiple layers of reinforcement to any of numerous handle structure designs.

The exemplary embodiments are described in the context of a carton that includes a top wall, a bottom wall, and first and second side walls, each connected to the next to form a tubular structure. Two of the walls of the tubular structure are secured together along an edge flap. More specifically, the edge flap is hingedly connected to one of the walls of the carton and adhesive is applied to the edge flap to secure the edge flap to another of the walls of the carton. Thereby, these walls of the carton are hingedly connected to one another by way of the edge flap.

An end closure is formed from end flaps at each open end of the tubular structure to define the end walls of the carton. At least one of the end flaps includes a handle opening that defines a handle in the end closure structure. For example, in certain of the illustrated embodiments, the top end flap includes a handle opening and the side end flaps include cutouts which together at least partially define the handle in the end closure structure. In any of potentially infinite variations of the exemplary embodiments, any combination of cutouts and apertures can be used to form the handle.

According to the present invention, the end closure includes at least a first edge flap reinforcing panel that is hingedly connected to the edge flap. In certain of the exemplary embodiments, a second edge flap reinforcing panel is hingedly connected to the first edge flap reinforcing panel, although additional edge flap reinforcing panels are contemplated, which may be connected to the first edge flap reinforcing panel or to the edge flap. Each edge flap reinforcing panel includes a reinforcing edge that is disposed in reinforcing proximity to the handle opening of the end closure structure. Each reinforcing edge reinforces at least a portion of the weight bearing edge of the handle opening that defines the handle.

The reinforcing edges of the one or more edge flap reinforcing panels have contours and dimensions that are complementary to the dimensions of the handle opening. In the exemplary embodiment, the reinforcing edge of each of the edge flap reinforcing panels is a lower edge. It is contemplated that, in other embodiments, one or both of the edge flap reinforcing panels can include a cutout or an aperture that defines a reinforcing edge.

In the illustrated embodiments, the tubular structure is formed from a top wall, a bottom wall, and first and second side walls. The end closures which are formed at each open end of the tubular structure are formed from end flaps which are hingedly connected to each of the walls of the tubular structure. Specifically, the end closure includes a top end flap that is hingedly connected to the top panel, which includes a handle opening disposed therethrough. The end closure also includes side end flaps that are hingedly connected to the first and second side walls respectively. In a first embodiment, each side end flap includes a cutout that is disposed or formed at a distal end edge of each side end flap. In either case, the cutout has dimensions that are complementary to the dimensions of at least part of the handle opening. One or both side end flaps can optionally include a side flap reinforcing panel having a reinforcing edge, the side flap reinforcing panel being foldable to place its reinforcing edge in reinforcing proximity to the respective cutout. The end closure and handle are formed as the top end flap is folded to at least partially overlie the first and second side end flaps so that the handle opening in the top end flap is in registry with the cutouts in the first and second side end flaps. The edge flap reinforcing panel can be secured to one or both of the side end flaps such that, as the end closure is formed, the edge flap reinforcing panel is disposed in reinforcing proximity to the handle opening so as to reinforce at least the weight bearing edge of the handle opening or to otherwise further form the handle.

In other embodiments, the end closure handle is formed from the handle opening in the top end flap and by the first and second edge flap reinforcing panels. Thereby, optionally, the handle is not formed by side end flap cutouts, which are in registry with the handle opening in other embodiments. In alternatives of such embodiments, the handle opening is defined in another of the end flaps. Further, the handle opening can be defined or approximated by cutouts in multiple end flaps such as the side end flaps.

In still other embodiments, the end closure handle can be formed from a handle opening in the top end flap, cutouts in the side end flaps, the first and second edge flap reinforcing panels, and at least one side flap reinforcing panel that is hingedly connected one of the side end flaps. Thus, at least a portion of the weight bearing edge of the handle is at least four plies thick.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
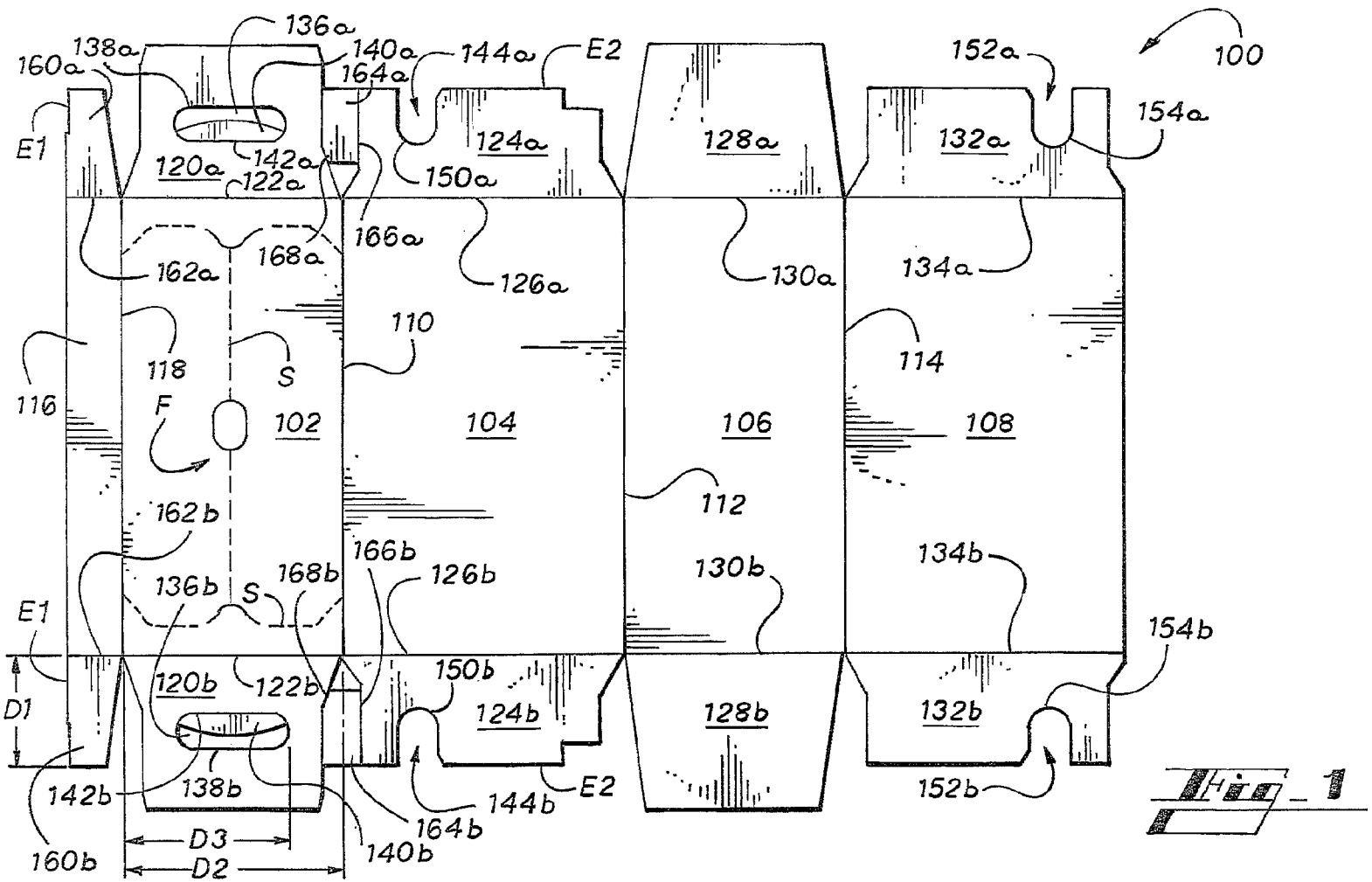
FIG. 1 is a plan view of a blank for forming a carton according to a first exemplary embodiment of the present invention.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings in which like numerals indicate like elements throughout the several views, the drawings illustrate certain of the various aspects of exemplary embodiments of a carton having handles defined by reinforced handle openings. Specifically, the carton includes a handle opening disposed in an end closure, wherein at least a part of the weight bearing portion of the periphery of the handle opening is reinforced by at least one edge flap reinforcing panel. At least the first edge flap reinforcing panel is hingedly connected to an edge flap that facilitates connecting the walls of a tubular structure. In the exemplary embodiments, the second edge flap reinforcing panel is hingedly connected to the first edge flap reinforcing panel.

The exemplary embodiments of the carton of the present invention are for enclosing, carrying, and dispensing articles such as beverage cans or bottles, although the teachings of the present invention may be incorporated in cartons or other containers that are utilized to package any suitable article. Generally described, the exemplary cartons are formed from a foldable sheet material such as paperboard, corrugated board, plastic, or the like.

Referring now to FIG. 1, to manufacture the first exemplary carton 200 (shown in FIG. 2), a blank 100 is cut from a single sheet of foldable sheet material, although it is contemplated that the blank 100 may include several separate panels that are secured together. The inside surface the blank 100 is shown. The blank 100 includes primary panels that form the walls of a tubular structure, as described in further detail below. The primary panels are aligned along a longitudinal axis of the blank 100 and hingedly connected one to the next along transverse fold lines, which are substantially perpendicular to the longitudinal axis of the blank 100. Specifically, the primary panels include a top panel 102, a first side panel 104, a bottom panel 106, and a second side panel 108. The top panel 102 is hingedly connected to the first side panel 104 along fold line 110, the first side panel 104 is hingedly connected to the bottom panel 106 along fold line 112, and the bottom panel 106 is hingedly connected to the second side panel 108 along fold line 114. In addition, the blank 100 includes an edge flap 116 that facilitates connecting the primary panels to form a tubular structure. The edge flap 116 is hingedly connected to the top panel 102 along fold line 118.

The blank 100 further includes end flaps that are hingedly connected to opposite end edges of each of the primary panels 102, 104, 106, 108. The end flaps are folded and secured to form end closures at each end of the erected carton 200, as described in further detail below. Top end flaps 120*a*, 120*b* are hingedly connected to top panel 102 along fold lines 122*a*, 122*b*. First side end flaps 124*a*, 124*b* are hingedly connected to first side panel 104 along fold lines 126*a*, 126*b*. Bottom end flaps 128*a*, 128*b* are hingedly connected to bottom panel 106 along fold lines 130*a*, 130*b*. Second side end flaps 132*a*, 132*b* are hingedly connected to second side end panel 108 along fold lines 134*a*, 134*b*. In addition, edge flap reinforcing panels 160*a*, 160*b* are hingedly connected to the edge flap 116 along fold lines 162*a*, 162*b*. The edge flap reinforcing panels 160*a*, 160*b* each have a reinforcing edge E1.

The blank 100 can optionally include an opening feature F to allow access to articles within the carton 200. For example, in the first embodiment, the top panel 102 includes a pattern of severance lines S that define the opening feature F. It should be understood that the opening feature F is not limited to the opening features F illustrated and described herein. Rather, the opening feature F is a design decision that is at least partially determined by the articles enclosed in the carton and how much access to those articles is desired. The opening feature F can be disposed in any one or more of the panels and can be defined by any pattern of severance lines. Further, the opening feature can include tear strips, zippers, cut lines, apertures, slits, and the like. It is also contemplated that the exemplary cartons can be partially enclosed such that a permanent opening is included in one or more walls. As used herein, the term "frangible line" or "severance line" includes, but is not limited to, perforations, a line of perforations, a line of short slits, a line of half cuts, a single half cut, any combination of perforations, slits, and half cuts, short score lines, combinations thereof and the like.

To provide the reinforced hand receiving apertures such as handles H (shown in FIG. 2) in end closures at each end of the carton 200, certain end flaps of the blank 100 include handle openings or cutouts. More specifically, top end flaps 120*a*, 120*b* include handle openings 136*a*, 136*b*; first side end flaps 124*a*, 124*b* include cutouts 144*a*, 144*b*; and second side end flaps 132*a*, 132*b* include cutouts 152*a*, 152*b*, respectively. The cutouts 144*a*, 152*a* are dimensioned and positioned such that they are complementary to a respective handle opening 136*a*, as described in further detail below.

Each of the handle openings 136*a*, 136*b* is an aperture defined by an endless edge 138*a*, 138*b*, respectively, that defines an ergonomic shape suitable for receiving the fingers of a user's hand so that the carton 200 can be easily lifted and carried. Although, the exemplary handle openings are formed from a single panel, the endless edge thereof may instead be approximated by portions of two or more adjacent panels. In the embodiment shown, cushioning flaps 140*a*, 140*b* are hingedly connected along a portion of the respective edge 138*a*, 138*b* of the handle openings 136*a*, 136*b*. Specifically, the portions of the edges 138*a*, 138*b* along which the cushioning flaps 140*a*, 140*b* are hingedly connected is defined by fold lines 142*a*, 142*b* that enable the cushioning flaps 140*a*, 140*b* to fold inward to provide a cushioned edge for a user to engage.

The cutouts 144*a*, 152*a* are defined by edges 150*a*, 154*a* such that the handle opening 136*a* and the cutouts 144*a*, 152*a* have complementary shapes, dimensions, and positions so as to be placed in registry with one another when the end flaps 120*a*, 124*a*, 132*a* are folded to overlie, overlap, or abut one another and thereby form a first end closure, as described in further detail below. Similarly, handle opening 136*b* and cutouts 144*b*, 152*b* are complementarily shaped, dimensioned, and positioned so as to be placed in registry with one another when end flaps 120*b*, 124*b*, 132*b* are folded to overlie, overlap, or abut one another and thereby form a second end closure, as described in further detail below.

Optionally, side flap reinforcing panels 164*a*, 164*b* are hingedly connected to side end flaps 124*a*, 124*b* along fold lines 166*a*, 166*b*, respectively, such that the side flap reinforcing panels 164*a*, 164*b* are foldable along the fold lines 166*a*, 166*b* to overlap the side end flaps 124*a*, 124*b* in reinforcing proximity to the cutouts 144*a*, 144*b*. Specifically, the side flap reinforcing panels 164*a*, 164*b* are foldable such that the reinforcing edges 168*a*, 168*b* of the side flap reinforcing panels 164*a*, 164*b* align with or are otherwise near a segment of the edges 150*a*, 150*b* that define the cutouts 144*a*, 144*b*. Further, the reinforcing edges 168*a*, 168*b* of the side flap reinforcing panels 164*a*, 164*b* abut, but are separated or separable from, the top end flaps 120*a*, 120*b*.

The exemplary carton 200 may be erected around an article or group of articles, or may be at least partially erected and then loaded and sealed. To facilitate an understanding of the configuration of the carton 200, one of potentially many contemplated techniques for erecting the carton 200 will now be described as a series of steps that may be performed substantially simultaneously or in any practical order, with some or all of the steps being performed either manually or automatically, such as by a packaging machine.

The exemplary process of erecting the carton is performed in two stages. The first stage is performed typically as part of the process of manufacturing the carton 200. In the first stage, a blank is cut, folded, and secured to form a flattened tubular structure so that it can be shipped to a packing facility as a sleeve. Specifically, in-plant equipment (IPE) at the manufacturing site cuts the blank 100 from a single sheet of foldable sheet material, as described above. Further, the IPE cuts, scores, imprints, or otherwise defines fold lines, severance lines, and cutout sections. For instance, the edges 138*a*, 138*b* of handle openings 136*a*, 136*b* may be defined by weakened severance lines that enable the center sections to be punched out, or the edges 138*a*, 138*b* may be defined by cut lines with the center sections being removed and discarded before the carton 200 is erected.

After the blank 100 is formed as shown in FIG. 1, the side flap reinforcing panels 164*a*, 164*b* are folded along fold lines 166*a*, 166*b* and secured to respective side end flaps 124*a*, 124*b* by adhesive or other means for securing such that the reinforcing edges 168*a*, 168*b* are disposed adjacent and in reinforcing proximity to a portion of the edges 150*a*, 150*b* of the cutouts 144*a*, 144*b*, respectively. Further, the edge flap 116 is folded so that the inside surface of the edge flap 116 is in a face contacting arrangement with the inside surface of top panel 102. Adhesive is applied to the outside surface of the edge flap 116 and, optionally, adhesive is applied to the outside surface of each of the reinforcing panels 160*a*, 160*b*. The blank 100 is then folded along fold line 112 so that the inside surface of top panel 102 is in a face contacting arrangement with the inside surface of second side panel 108 and the outside surface of edge flap 116 is thereby secured to the inside surface of second side panel 108. The outside surfaces of the edge flap reinforcing panels 160*a*, 160*b* are in a face contacting arrangement with, and thereby secured to, the inside surfaces of the end flaps 132*a*, 132*b*, respectively. The edge flap reinforcing panels 160*a*, 160*b* are dimensioned, shaped, and positioned so as to reinforce at least a portion of edge 154*a*, 154*b* formed in end flap 132*a*, 132*b* without obstructing the cutouts 152*a*, 152*b*. In the exemplary embodiment, the reinforcing edges E1 of the edge flap reinforcing panels 160*a*, 160*b* are positioned adjacent to the edges 154*a*, 154*b* of the cutouts 152*a*, 152*b* to reinforce the upper or weight bearing portion of the end flaps 132*a*, 132*b* (as best shown in FIG. 3).

The second stage of erecting the carton 200 may be performed at a bottling or packaging facility. The flattened blanks 100 are loaded into a packaging machine, which in known fashion, disposes top panel 102 opposite bottom panel 106 and disposes first side panel 104 opposite second side panel 108 so that the carton 200 is configured as a tubular structure having a substantially rectangular cross section, as shown in FIG. 3, although trapezoidal or gabled cross sections are also contemplated. Thus, top panel 102 becomes top wall 202, first side panel 104 becomes first side wall 204, bottom panel 106 becomes bottom wall 206, and second side panel 108 becomes second side wall 208.

Articles (not shown) are loaded into the carton 200 through one or both of the now open ends, and then the ends are sealed as the end flaps are folded and secured to form end closures. The ends of the carton 200 are substantially identical, with similar parts being identified using the same element number modified by the suffix "a" or "b", where element numbers ending in "a" are associated with end closure 210, and elements identified with "b" are associated with end closure 212. Accordingly, formation of only one of the end closures 210, 212 will be described in detail below.

Figure 3:
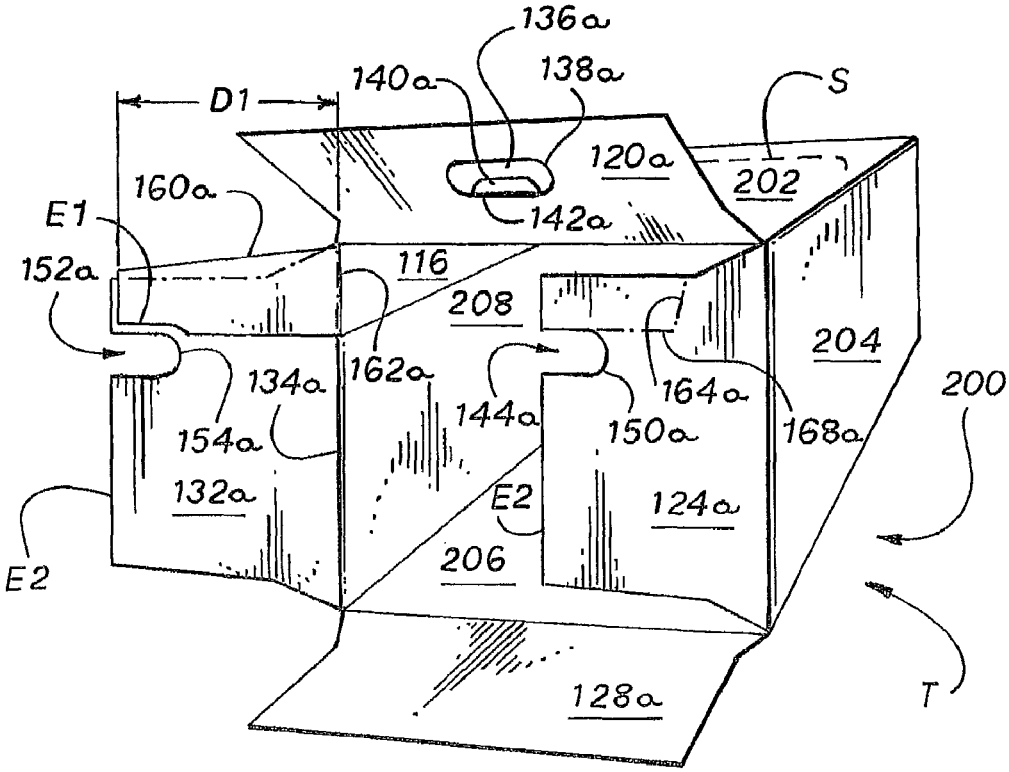
FIG. 3 is a perspective view of the carton of FIG. 2 as it undergoes a step in an exemplary method of forming an end closure.

Referring to FIG. 3, the first side panel 124*a* and the second side panel 132*a* are folded toward the interior of the carton 200 until the distal edges E2 of the panels 124*a*, 132*a* abut or overlap slightly. In this manner, the cutouts 144*a*, 152*a* come together to approximate the dimensions of the handle opening 136*a*. It should be noted that the handle opening 136*a* may be relatively larger or smaller than the cutouts 144*a*, 152*a* to account for slight variations in alignment. It should also be noted that the fold line 162*a* is disposed adjacent to the fold 134*a* such that the edge flap reinforcing panel 160*a* and the side end flap 132*a* can fold as one when they are secured together.

Figure 2:
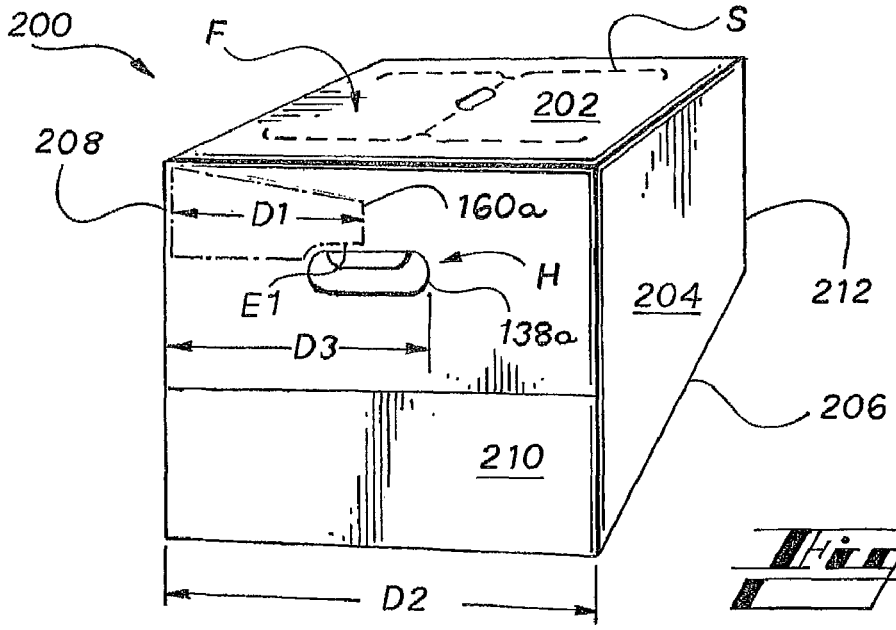
FIG. 2 is a perspective view of a carton formed from the blank of FIG. 1.

Adhesive is applied to the inside surface of bottom end flap 128*a*, and bottom end flap 128*a* is folded toward the interior of the carton 200 so that its inside surface is secured in a face contacting arrangement to the lower portions of the outside surfaces of side end flaps 124*a*, 132*a*. Adhesive is applied to the inside surface of top end flap 120*a*, and top end flap 120*a* is folded toward the interior of the carton 200 so that its inside surface is secured in a face contacting arrangement to the upper portions of the outside surfaces of side end flaps 124*a*, 132*a*. Top end flap 120*a* may overlap bottom end flap 128*a* somewhat (as shown in FIG. 2), bottom end flap 128*a* may overlap top end flap 120*a*, or the end flaps 120*a*, 128*a* may not necessarily overlap one another. The top end flap 120*a* is folded and secured to the side end flaps 124*a*, 132*a* such that the handle opening 136*a* aligns with the cutouts 144*a*, 152*a* to at least partially define the handle H.

Once the carton 200 is fully erected as shown in FIG. 2, each end closure 210, 212 includes a handle H having edges that, in the first embodiment, are triply reinforced. A portion of the periphery of the handle H, as defined by edge 138*a* of handle opening 136*a*, is substantially aligned with and reinforced by the edge 150*a* of cutout 144*a* and by the edge of side flap reinforcing panel 164*a* that is defined by cut line 168*a*. Another portion of the periphery of the handle H, as defined by edge 138*a* of handle opening 136*a*, is substantially aligned with and reinforced by the edge 154*a* of cutout 152*a* and by the reinforcing edge E1 of the edge flap reinforcing panel 160*a*. Thereby, at least the upper or weight bearing edge of the handle H is three plies thick. Those skilled in the art will readily appreciate that reinforcement is most needed along the weight-bearing portion of a handle of a carton.

It should be understood that, in alternative embodiments, the edge flap reinforcing panel 160*a* can be designed to provide an independent layer of reinforcement to the weight bearing edge of the handle opening 136*a* to provide a handle H and, in other embodiments, the edge flap reinforcing panel 160*a* can be designed to cooperate with one or more side flap reinforcing panels to provide a single layer of reinforcement to at least the weight bearing edge of the handle opening 136*a* to provide a handle H. In certain other embodiments, the edge flap reinforcing panel 160*a* overlaps one or more side flap reinforcing panels to provide multiple layers of reinforcement to the handle opening 136*a* and thereby provide a thicker weight bearing edge of the handle H.

For example, in the first embodiment, the edge flap reinforcing panel 160*a* and the side flap reinforcing panel 164*a* combine to provide a single layer of reinforcement to the weight bearing edge of the handle opening 136*a*. The edge flap reinforcing panel 160*a* and the side flap reinforcing panel 164*a* each reinforce approximately half of a portion of the upper or weight bearing edge of the handle opening 136*a*. Accordingly, the edge flap reinforcing panel 160*a* extends to approximately the center of the handle H or otherwise to the distal edge E2 of the side end flap 132*a*. Further, the length D1 of the edge flap reinforcing panel 160*a* is approximately half of the width D2 of the top end flap 120*a*, approximately half of the width of the end closure 210, or approximately equal to the length of the side end flap 132*a*.

In alternative embodiments, the length D1 of the edge flap reinforcing panel 160*a* can be extended such that the edge flap reinforcing panel 160*a* reinforces a greater portion of the weight bearing edge of the handle opening 136*a*. For example, the length D1 of the edge flap reinforcing panel 160*a* can be approximately equal to a length D3, which is defined between the fold line 118 and a far end of the handle opening 136*a* or the handle H. In such embodiments, the edge flap reinforcing panel 160*a* can overlap both side end flaps 124*a*, 132*a* so as to provide an independent layer or reinforcement to the weight bearing edge of the handle opening 136*a*. These embodiments can optionally include side flap reinforcing panels, including those discussed in further detail below, to provide yet another ply of material to the handle H or the side flap reinforcing panels can be omitted.

Figure 4:
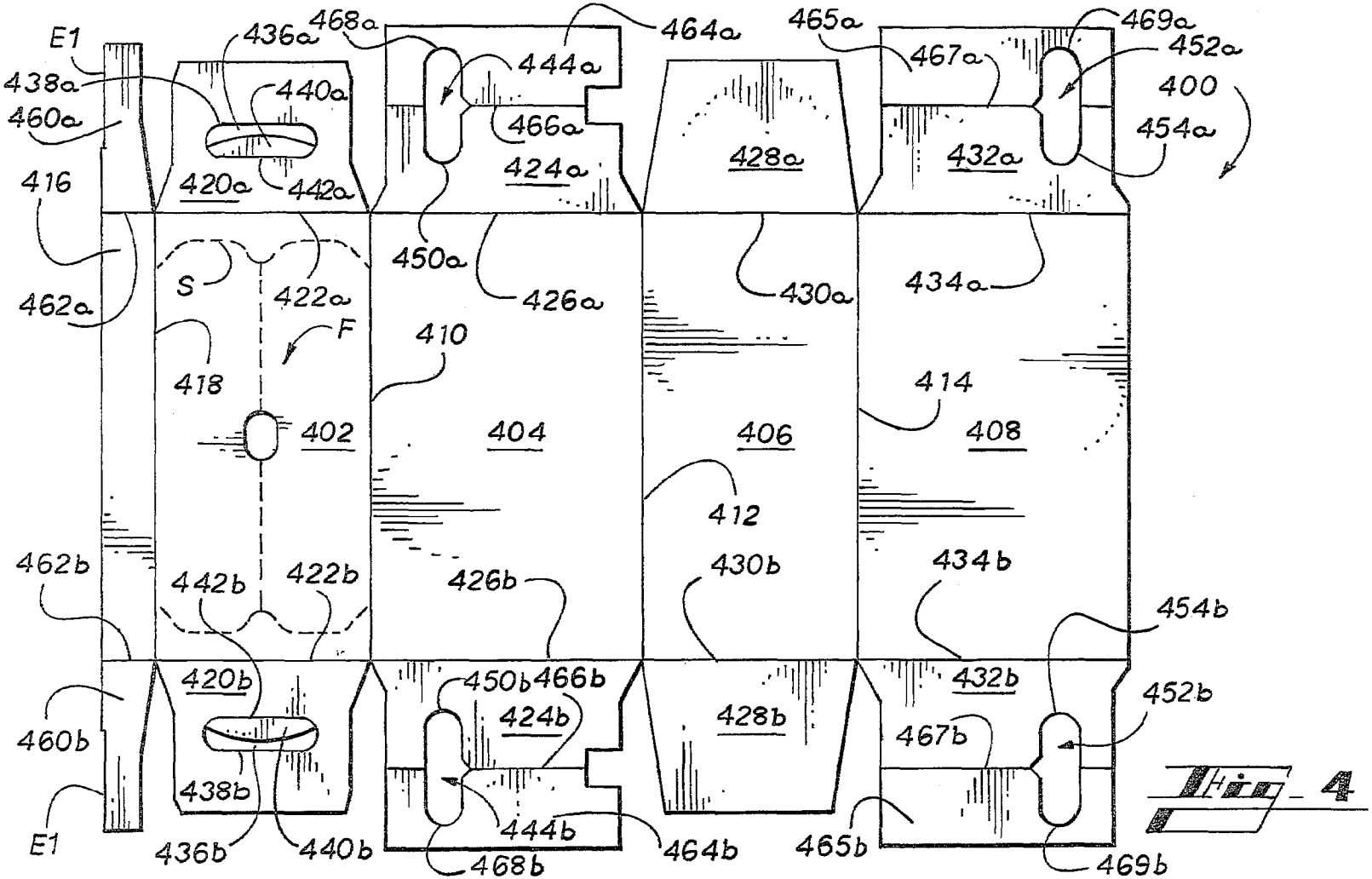
FIG. 4 is a plan view of a blank for forming a carton according to a second exemplary embodiment of the present invention.
Figure 5:
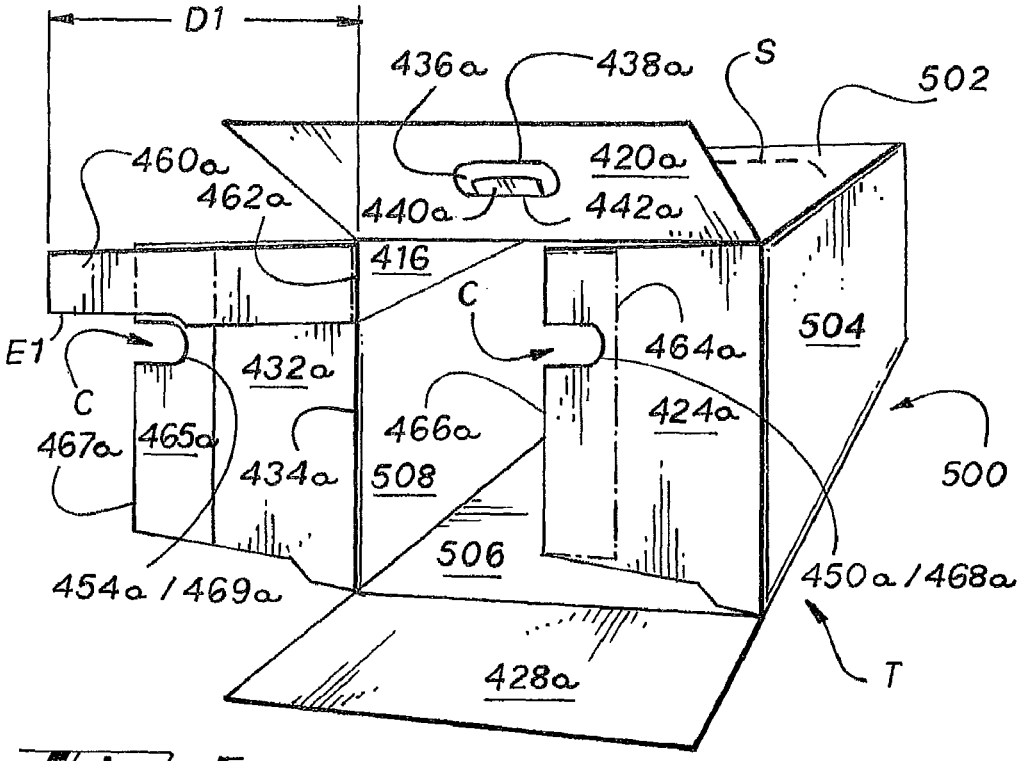
FIG. 5 is a perspective view of a carton formed from the blank of FIG. 4 as it undergoes a step in an exemplary method of forming an end closure.

A second embodiment will now be described that further exemplifies the principles and teachings of the present invention. Carton 500 (shown partially erected in FIG. 5) is formed from blank 400 (shown in FIG. 4), and embodies an alternative configuration that provides triple reinforcement of the handle opening 436*a* to form a four ply thick handle H. Generally, blank 400 differs from blank 100 principally by the substitution of handle openings 452*a*, 452*b*, 444*a*, 444*b* for cutouts 152*a*, 152*b*, 144*a*, 144*b* in the side end flaps 432*a*, 432*b*, 424*a*, 424*b* and in side flap reinforcing panels 465*a*, 465*b*, 464*a*, 464*b*. The side flap reinforcing panels 465*a*, 465*b*, 464*a*, 464*b* are alternatively configured so as to be defined from or otherwise hingedly connected to the side end flaps 432*a*, 432*b*, 424*a*, 424*b* by fold lines 467*a*, 467*b*, 466*a*, 466*b*. In this embodiment, the fold lines 467*a*, 467*b*, 466*a*, 466*b* are interrupted by the handle openings 452*a*, 452*b*, 444*a*, 444*b* such that, as the side flap reinforcing panels 465*a*, 465*b*, 464*a*, 464*b* are folded along respective fold lines 467*a*, 467*b*, 466*a*, 466*b* and secured in a face contacting arrangement with the side end flaps 432*a*, 432*b*, 424*a*, 424*b*, the handle openings 452*a*, 452*b*, 444*a*, 444*b* define cutouts C (shown in FIG. 5). Specifically, the handle openings 452*a*, 452*b*, 444*a*, 444*b* define edges 450*a*, 450*b*, 454*a*, 454*b* in side end flaps 424*a*, 424*b*, 432*a*, 432*b* and edges 468*a*, 468*b*, 469*a*, 469*b* in side flap reinforcing panels 465*a*, 465*b*, 464*a*, 464*b*. As the side flap reinforcing panels 465*a*, 465*b*, 464*a*, 464*b* are folded along respective fold lines 467*a*, 467*b*, 466*a*, 466*b* the edges 468*a*, 468*b*, 469*a*, 469*b* align with and reinforce the edges 450*a*, 450*b*, 454*a*, 454*b*. Further, in the second embodiment, the edge flap reinforcing panels 460*a*, 460*b* are lengthened with respect to the first embodiment so as to reinforce a greater portion of the weight bearing portion of the handle openings 436*a*, 436*b*. Specifically, the reinforcing edges E1 of the edge flap reinforcing panels reinforce a greater portion of the edges 438*a*, 438*b* of the handle openings 436*a*, 436*b* so as to provide a stronger weight bearing edge of the handle H.

Once the side flap reinforcing panels 465*a*, 465*b*, 464*a*, 464*b* are folded along respective fold lines 467*a*, 467*b*, 466*a*, 466*b* to define cutouts C, the blank 400 can be folded and secured to form the carton 500 by substantially the same method described above with respect to the blank 100. However, it should be understood that, as the side end flaps 424*a*, 432*a* are folded inwardly, the edge flap reinforcing panel 460*a* is folded along with the side end flap 432*a* and the distal end of the edge flap reinforcing panel 460*a* overlaps the side end flap 424*a*. Thus, as each of the end closures are formed, a portion of the reinforcing edge E1 of the edge flap reinforcing panel 460*a* is placed in reinforcing proximity to the weight-bearing edge or portion of the handle opening 436*a*. In the embodiment shown in FIG. 5, a portion of the periphery of the handle H, as defined by edge 438*a*, is substantially aligned with and reinforced by the edges 450*a*/468*a*, 454*a*/469*a* of the cutouts C and by the reinforcing edge E1 of edge flap reinforcing panel 460*a*. Thereby, at least the upper or weight bearing edge of the handle H is four plies thick.

Figure 7:
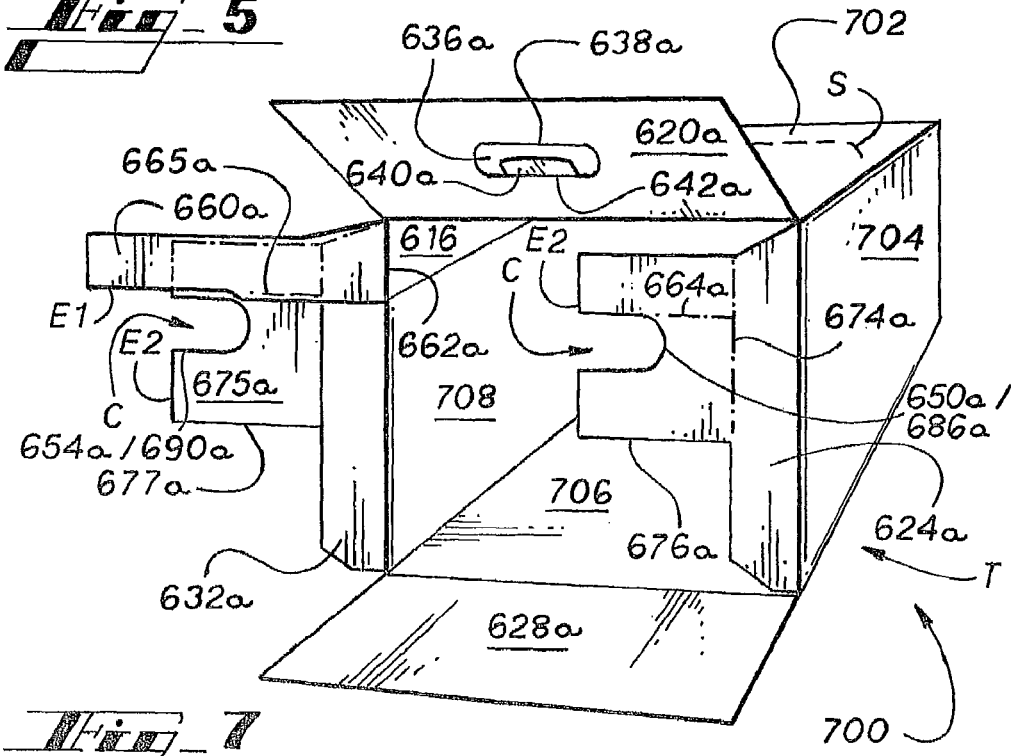
FIG. 7 is a perspective view of a carton formed from the blank of FIG. 6 as it undergoes a step in an exemplary method of forming an end closure.
Figure 6:
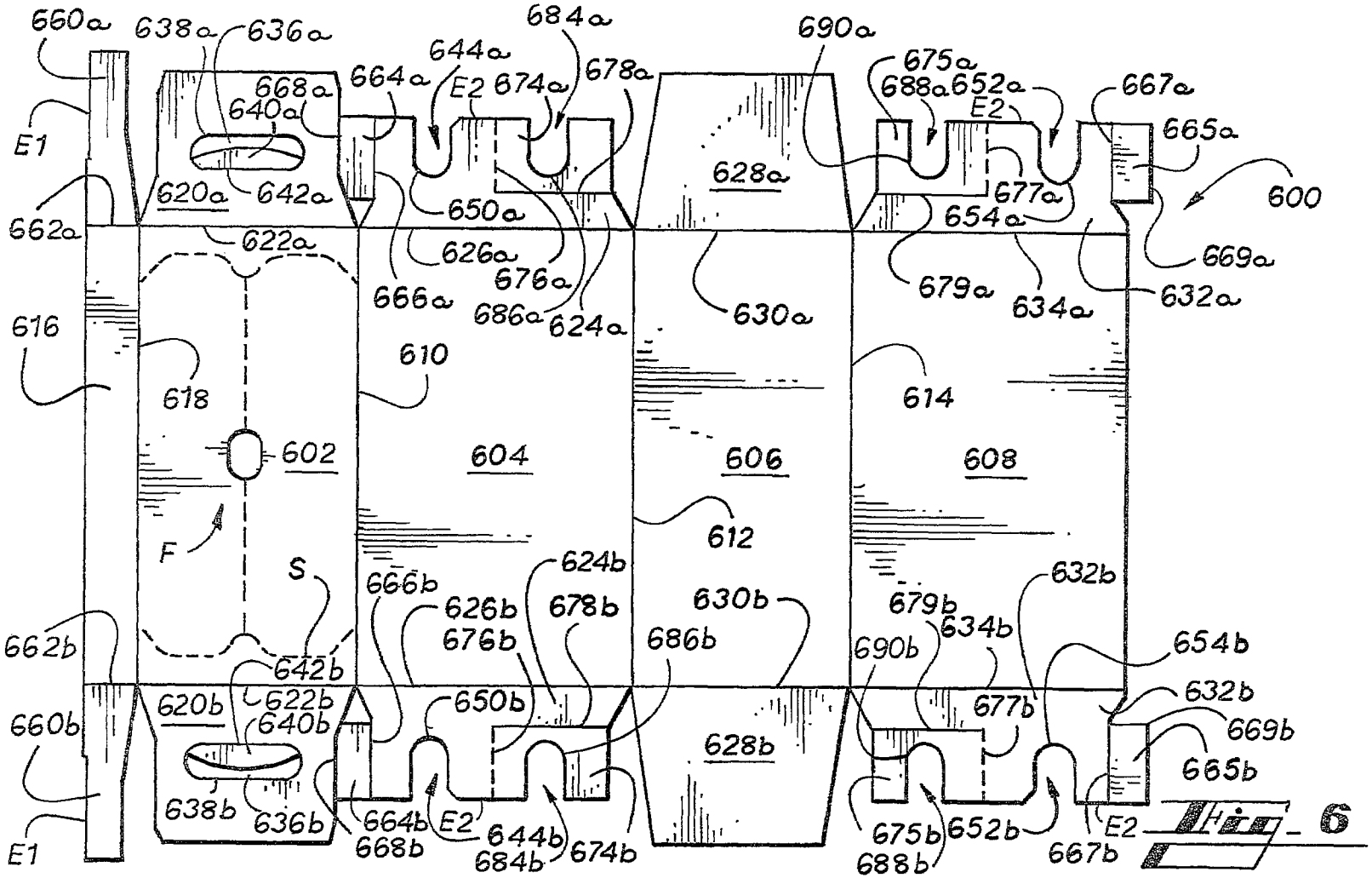
FIG. 6 is a plan view of a blank for forming a carton according to a third exemplary embodiment of the present invention.

A third embodiment will now be described that also exemplifies the principles and teachings of the present invention. Carton 700 (shown partially erected in FIG. 7) is formed from blank 600 (shown in FIG. 6), and embodies an alternative configuration that provides five-ply handles H. Generally, blank 600 differs from blank 100 principally by the inclusion of side flap reinforcing panels 665*a*, 665*b*, which are hingedly connected to side end flaps 632*a*, 632*b* along fold lines 667*a*, 667*b*, in addition to the side flap reinforcing panels 664*a*, 664*b*, which are hingedly connected to side end flaps 624*a*, 624*b* along fold lines 666*a*, 666*b*. In addition, auxiliary side flap reinforcing panels 674*a*, 674*b*, 675*a*, 675*b* are formed from or otherwise hingedly connected to side end flaps 624*a*, 624*b*, 632*a*, 632*b* along fold lines 676*a*, 676*b*, 677*a*, 677*b*. Further, the auxiliary side flap reinforcing panels 674*a*, 674*b*, 675*a*, 675*b* are separated from the side end flaps 624*a*, 624*b*, 632*a*, 632*b* by cut lines 678*a*, 678*b*, 679*a*, 679*b* and each include cutouts 684*a*, 684*b*, 688*a*, 688*b* which are defined by edges 686*a*, 686*b*, 654*a*, 654*b*. The cutouts 684*a*, 684*b*, 688*a*, 688*b* and the cutouts 644*a*, 644*b*, 652*a*, 652*b* have complementary shapes, dimensions, and positions so as to be placed in registry with one another when the auxiliary side flap reinforcing panels 674*a*, 674*b*, 675*a*, 675*b* are folded along fold lines 676*a*, 676*b*, 677*a*, 677*b* to overlap the side end flaps 624*a*, 624*b*, 632*a*, 632*b*. Accordingly, the edges substantially align with the edges 686*a*, 686*b*, 654*a*, 654*b*.

The side flap reinforcing panel 664*a* and the auxiliary side flap reinforcing panel 674*a* are folded along respective fold lines 666*a*, 676*a* to overlap one another such that a portion of the side end flap 624*a* adjacent to the cutout 644*a* is three plies thick. Once each of the side flap reinforcing panels and the auxiliary side flap reinforcing panels have been folded and secured in this manner, the blank 600 can be folded and secured to form the carton 700 by substantially the same method described above with respect to the blank 400. Thus, in the embodiment shown in FIG. 7, a portion of the periphery of the handle H, as defined by edge 638*a* of handle opening 636*a*, is substantially aligned with and reinforced by a reinforced portion of the side end flaps 624*a*, 632*a*, as defined by the three-ply edges 650*a*/668*a*/686*a*, 654*a*/669*a*/690*a*, and aligned with and reinforced by a reinforced edge E1 of edge flap reinforcing panel 660*a*. Thereby, at least the upper or weight bearing edge of the handle H is five plies thick.

Figure 8:
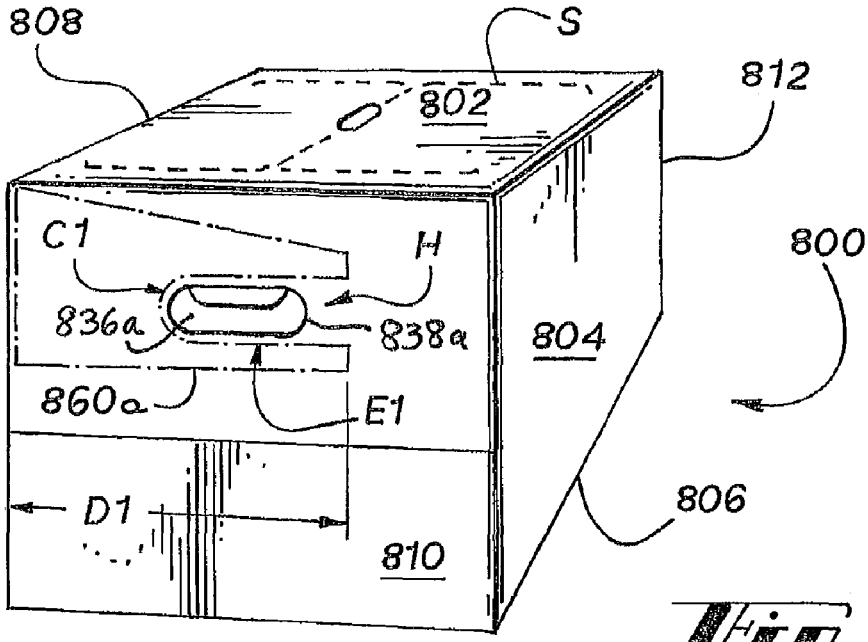
FIG. 8 is a perspective view of a carton including an alternative embodiment of an edge flap reinforcing panel according to the present invention.
Figure 9:
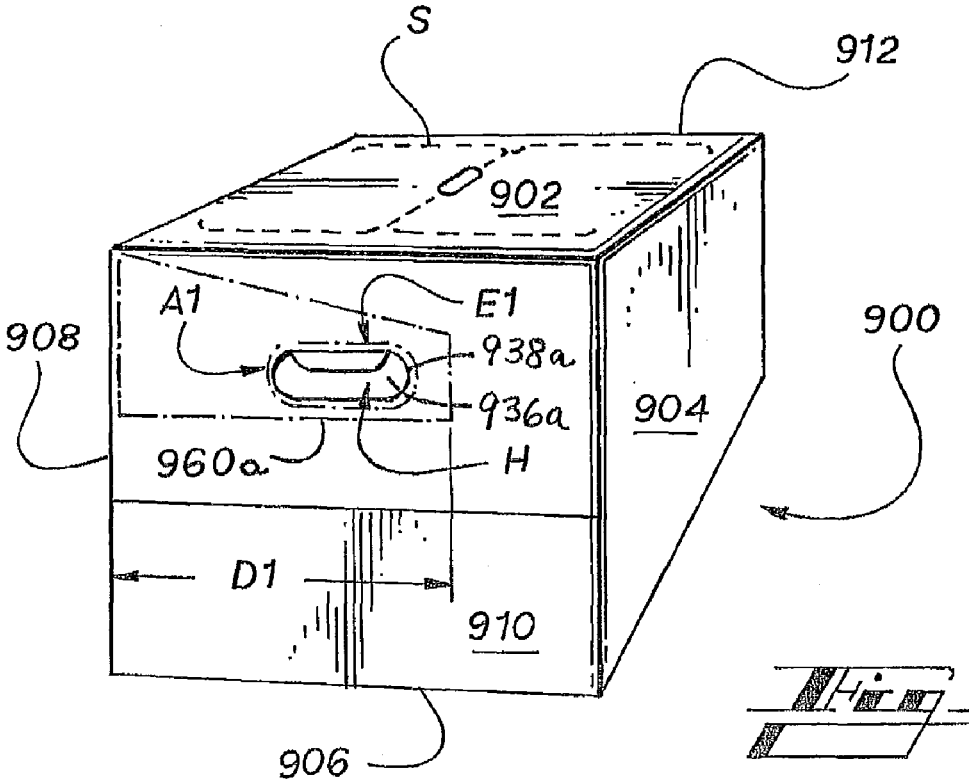
FIG. 9 is a perspective view of a carton including yet another alternative embodiment of an edge flap reinforcing panel according to the present invention.

In alternative embodiments shown in FIGS. 8 and 9, the edge flap reinforcing panel has a greater width than the edge flap reinforcing panels that are illustrated in previous embodiments and further includes features such that the edge flap reinforcing panel reinforces a greater portion of the periphery of the handle opening. Referring to FIG. 8, the edge flap reinforcing panel 860*a* includes a cutout C1 such that a portion of the edge 838*a* of the handle opening 836*a*, which at least partially defines the handle H in the end closure 810 of the carton 800, is reinforced by a reinforcing edge E1 of the cutout C1. Thereby, a majority of the periphery of the handle opening 836*a* is reinforced.

Referring to FIG. 9, the edge flap reinforcing panel 960*a* includes an aperture A1 that is in registry with the handle opening 936*a* such that edge 938*a* of the handle opening 936*a*, which at least partially defines the handle H in the end closure 910 of the carton 900, is reinforced by the reinforcing edge E1 of the aperture A1. Thereby, the entire periphery of the handle opening 936*a* is reinforced.

Figure 10:
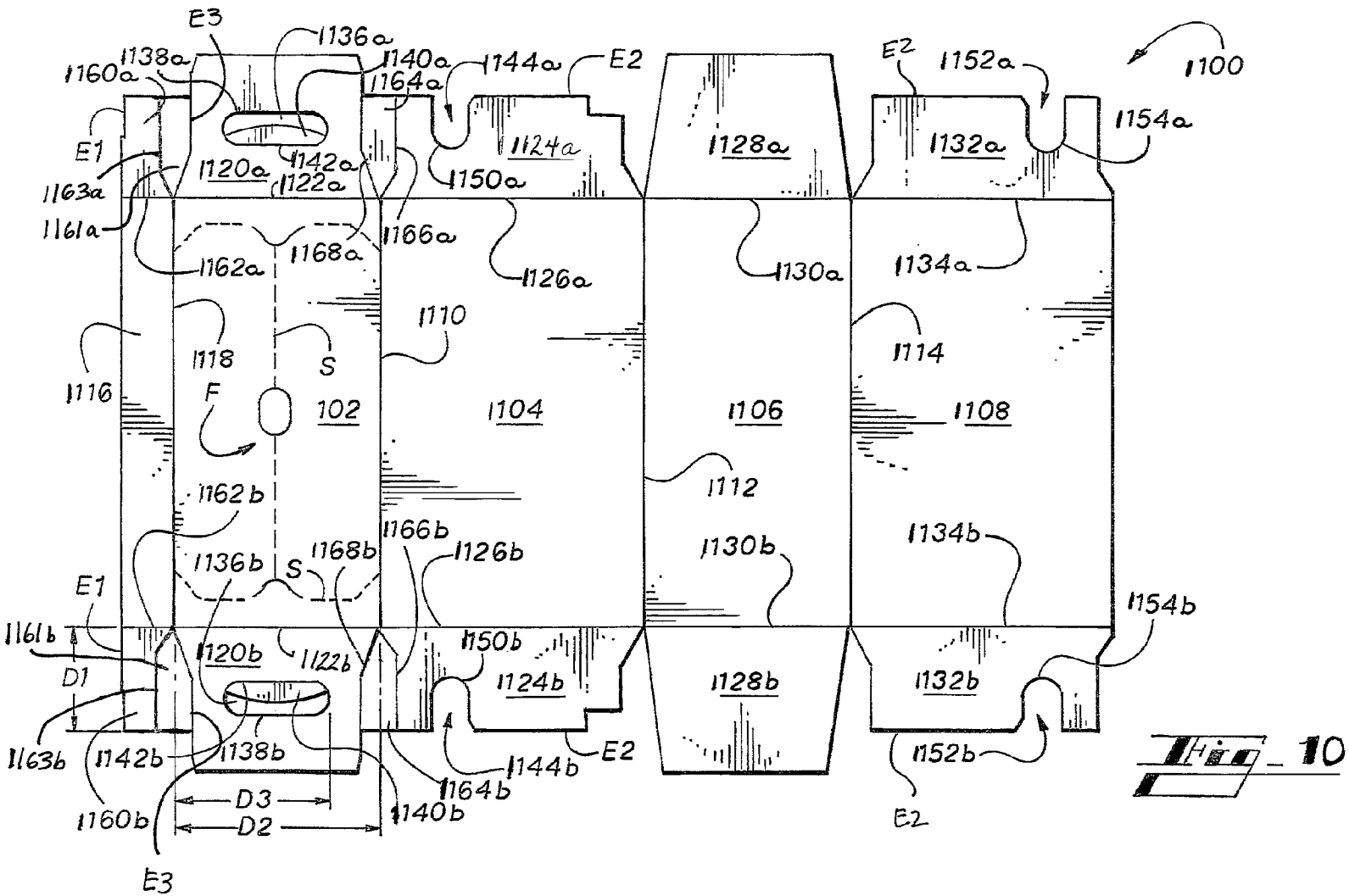
FIG. 10 is a plan view of a blank for forming a carton according to still another exemplary embodiment of the present invention.
Figure 11:
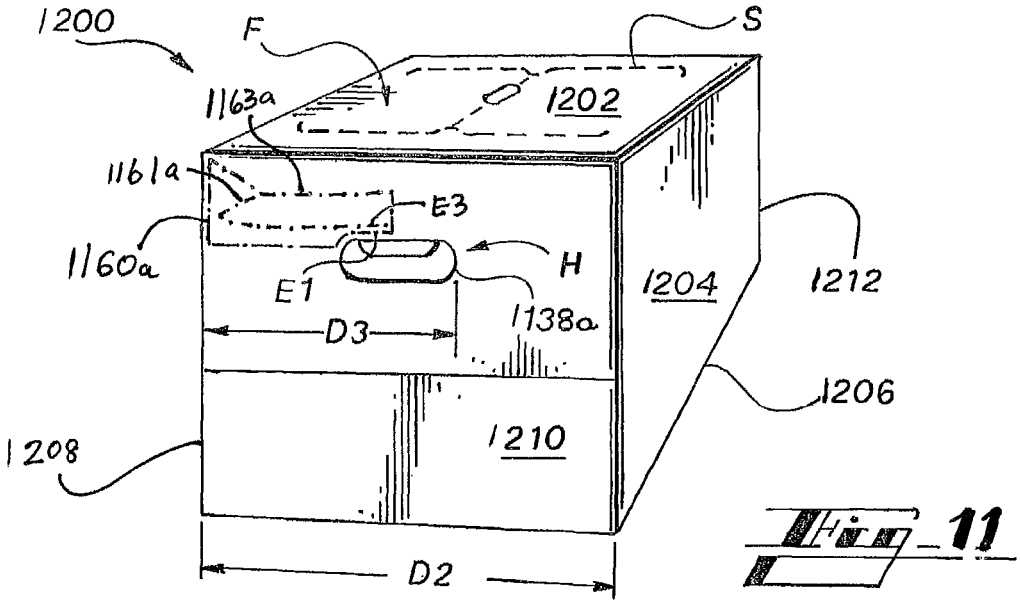
FIG. 11 is a perspective view of a carton formed from the blank of FIG. 10.
Figure 12:
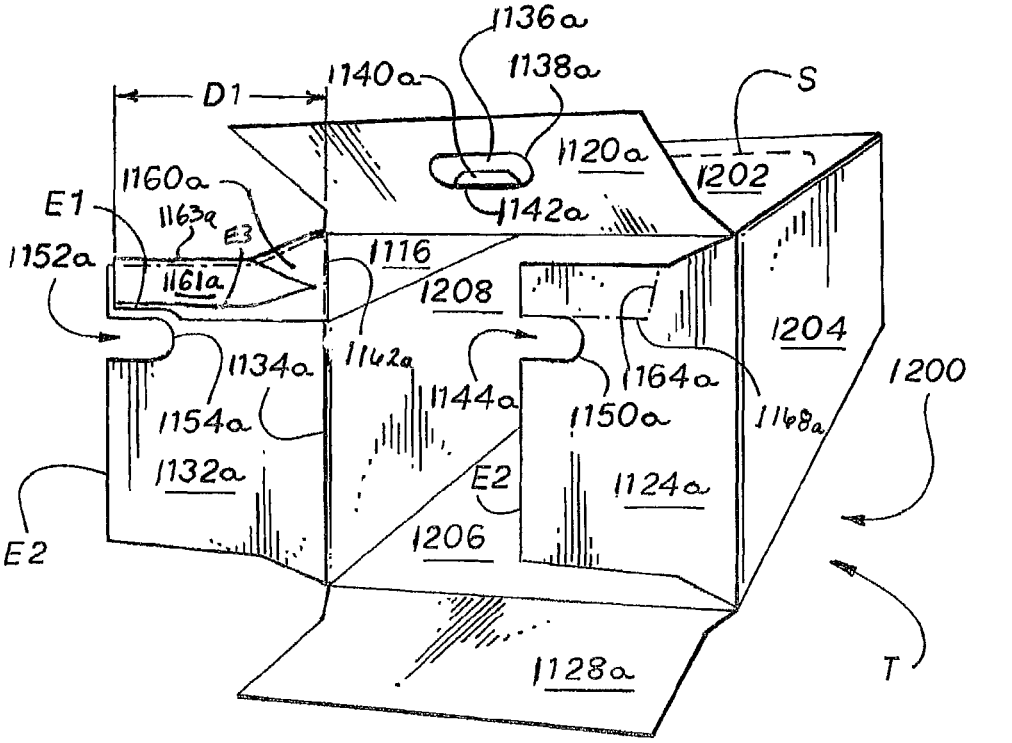
FIG. 12 is a perspective view of the carton of FIG. 11 as it undergoes a step in an exemplary method of forming an end closure.

Another embodiment, shown in FIGS. 10 through 12, illustrates that the teachings and advantages of the present invention can be further advanced by adding one or more additional edge flap reinforcing panels to the blank, and by hingedly connected the additional edge flap reinforcing panels directly or indirectly to the edge flap. Referring now to FIG. 10, the exemplary carton 1200 (shown in FIG. 11), is manufactured from a blank 1100. The blank 1100 is substantially identical to the blank 100, except for the addition of additional reinforcing panels, thus like numerals are used to identify like elements, with the addition of the prefix "1" before element numbers used to distinguish embodiment of FIG. 10. The blank 1100 includes primary panels that include a top panel 1102, a first side panel 1104, a bottom panel 1106, and a second side panel 1108. The top panel 1102 is hingedly connected to the first side panel 1104 along fold line 1110, the first side panel 1104 is hingedly connected to the bottom panel 1106 along fold line 1112, and the bottom panel 1106 is hingedly connected to the second side panel 1108 along fold line 1114. In addition, the blank 1100 includes an edge flap 1116 that facilitates connecting the endmost primary panels to form a tubular structure. The edge flap 1116 is hingedly connected to the top panel 1102 along fold line 1118.

In this embodiment, second edge flap reinforcing panels 1161*a*, 1161*b* are hingedly connected to the first edge flap reinforcing panels 1160*a*, 1160*b* along fold lines 1163*a*, 1163*b*. The first edge flap reinforcing panels 1160*a*, 1160*b* each have a reinforcing edge E1 and the second edge flap reinforcing panels 1161*a*, 1161*b* each have a reinforcing edge E3. The reinforcing edges E3 of the second edge flap reinforcing panels 1161*a*, 1161*b* abut, but are separated or separable from, the top end flaps 1120*a*, 1120*b*.

After the blank 1100 is formed as shown in FIG. 10, the side flap reinforcing panels 1164*a*, 1164*b* are folded along fold lines 1166*a*, 1166*b* and secured to respective side end flaps 1124*a*, 1124*b* by adhesive or other means for securing such that the reinforcing edges 1168*a*, 1168*b* are disposed adjacent and in reinforcing proximity to a portion of the edges 1150*a*, 1150*b* of the cutouts 1144*a*, 1144*b*, respectively. The second edge flap reinforcing panels 1161*a*, 1161*b* are folded along fold lines 1163*a*, 1163*b* so as to be in a face contacting arrangement with the first edge flap reinforcing panels 1160*a*, 1160*b* such that the reinforcing edges E3 are disposed adjacent to the reinforcing edges E1 of the first edge flap reinforcing panels 1160*a*, 1160*b*. According to an exemplary method, the inside surfaces of the second edge flap reinforcing panels 1161*a*, 1161*b* are in a face contacting arrangement with the inside surfaces of the first edge flap reinforcing panels 1160*a*, 1160*b*. However, it is contemplated that the outside surfaces of the first and second edge flap reinforcing panels 1160*a*, 1161*a* can be in a face contacting arrangement.

Further, the edge flap 1116 is folded so that the inside surface of the edge flap 1116 is in a face contacting arrangement with the inside surface of top panel 1102. Adhesive is applied to the outside surface of the edge flap 1116 and, optionally, adhesive is applied to the outside surfaces of the first edge flap reinforcing panels 1160*a*, 1160*b*. The blank 1100 is then folded along fold line 1112 so that the inside surface of top panel 1102 is in a face contacting arrangement with the inside surface of second side panel 1108 and the outside surface of edge flap 1116 is thereby secured to the inside surface of second side panel 1108. The outside surfaces of the edge flap reinforcing panels 1160*a*, 1160*b* are in a face contacting arrangement with, and thereby secured to, the inside surfaces of the end flaps 1132*a*, 1132*b*, respectively.

The first and second edge flap reinforcing panels 1160*a*, 1161*a* are dimensioned, shaped, and positioned so as to reinforce at least a portion of the edge 1154*a* formed in end flap 1132*a* without obstructing the cutout 1152*a*. In the exemplary embodiment, the reinforcing edges E1, E3 of the first and second edge flap reinforcing panels 1160*a*, 1161*a* are positioned adjacent to the edge 1154*a* of the cutout 1152*a* to reinforce the upper or weight bearing portion of the end flaps 1132*a* (as best shown in FIG. 12).

Once the carton 1200 is fully erected as shown in FIG. 11, each end closure 1210, 1212 includes a handle H having edges that, in the first embodiment, are four-plies thick. A portion of the periphery of the handle H, as defined by edge 1138*a* of handle opening 1136*a*, is substantially aligned with and reinforced by the edge 1150*a* of cutout 1144*a* and by the edge 1168*a* of side flap reinforcing panel 1164*a*. Another portion of the periphery of the handle H, as defined by edge 1138*a* of handle opening 1136*a*, is substantially aligned with and reinforced by the edge 1154*a* of cutout 1152*a*, by the reinforcing edge E1 of the first edge flap reinforcing panel 1160*a*, and by the reinforcing edge E3 of the second edge flap reinforcing panel 1161*a*. Thereby, at least the upper or weight bearing edge of the handle H is four plies thick. Those skilled in the art will readily appreciate that reinforcement is most needed along the weight-bearing portion of a handle of a carton.

It should be understood that, in alternative embodiments, the first and second edge flap reinforcing panels 1160*a* can be designed to provide an independent two-ply layer of reinforcement to the weight bearing edge of the handle opening 1136*a* to define a handle H. In other embodiments, the first and second edge flap reinforcing panels 1160*a*, 1161*a* can be designed to cooperate with one or more side flap reinforcing panels to provide multiple layers of reinforcement to at least the weight bearing edge of the handle opening 1136*a* to define a handle H. In certain other embodiments, one or both of the first and second edge flap reinforcing panels 1160*a*, 1161*a* overlaps one or more side flap reinforcing panels to provide multiple layers of reinforcement to the handle opening 1136*a* and thereby provide a thicker weight bearing edge of the handle H.

For example, in the first embodiment, the first edge flap reinforcing panel 1160*a* and the side flap reinforcing panel 1164*a* combine to provide a single layer of reinforcement to the weight bearing edge of the handle opening 1136*a*. The first edge flap reinforcing panel 1160*a* and the side flap reinforcing panel 1164*a* each reinforce approximately half of the upper or weight bearing edge of the handle opening 1136*a*. The second edge flap reinforcing panel 1161*a* overlaps the first edge flap reinforcing panel 1160 to additionally reinforce a half of the weight bearing edge of the handle opening 1136*a*. Accordingly, the first and second edge flap reinforcing panels 1160*a*, 1161*a* extend to approximately the center of the handle H or otherwise to the distal edge E2 of the side end flap 1132*a*. Further, the length D1 of each of the first and second edge flap reinforcing panels 1160*a* is approximately half of the width D2 of the top end flap 1120*a*, approximately half of the width of the end closure 1210, or approximately equal to the length of the side end flap 1132*a*.

In alternative embodiments, the length D1 of one or both of the first and second edge flap reinforcing panels 1160*a*, 1161*a* can be extended such that one or both of the first and second edge flap reinforcing panels 1160*a*, 1161*a* reinforce a greater portion of the weight bearing edge of the handle opening 1136*a*. For example, the length D1 of the first and second edge flap reinforcing panels 1160*a*, 1161*a* can be approximately equal to a length D3, which is defined between the fold line 1118 and a far end of the handle opening 1136*a* or the handle H. In such embodiments, the first and second edge flap reinforcing panels 1160*a*, 1161*a* can overlap both side end flaps 1124*a*, 1132*a* so as to provide an independent two-ply layer or reinforcement to the weight bearing edge of the handle opening 1136*a*. These embodiments can optionally include side flap reinforcing panels, including those discussed in further detail below, to provide yet another ply of material to the handle H or the side flap reinforcing panels can be omitted.

The present invention has been illustrated in relation to a particular embodiment which is intended in all respects to be illustrative rather than restrictive. For example, as used herein, directional references such as "top", "base", "bottom", "end", "side", "inner", "outer", "upper", "middle", "lower", "front" and "rear" do not limit the respective walls of the carton to such orientation, but merely serve to distinguish these walls from one another. Furthermore, the various embodiments demonstrate that the top, sides, and bottom panels may be hingedly connected to one another and secured into a tubular sleeve in any order that provides a top panel opposing a bottom panel and opposing side panels. Any reference to hinged connection should not be construed as necessarily referring to a junction including a single hinge only; indeed, it is envisaged that hinged connection can be formed from one or more potentially disparate means for hingedly connecting materials. The exemplary cartons preferably have handles at both ends, although it is contemplated to include only one handle disposed in one of the end closures.

Those skilled in the art will also appreciate that any suitable means for securing sheet material may be used, including magnets, non-permanent adhesives, or hook and loop fasteners such as VELCRO®, which is a trademark registered to Velcro Industries B.V. Additionally, although the handle openings of the invention are described as having removable centers, the centers may be only partially removable and may function as finger cushions after being partially detached from the edges of the handle openings.

It must be emphasized that the above-described embodiments are merely exemplary illustrations of implementations set forth for a clear understanding of the principles of the invention. Many variations and modifications may be made to the above-described embodiments without departing from the scope of the claims. Accordingly, all such modifications, combinations, and variations are included herein by the scope of this disclosure and the following claims.

What is claimed is:

1. A carton, comprising:

a tubular structure comprising multiple walls;

an edge flap connecting two of said walls; and at least one end closure that comprises:

a handle opening;

a first edge flap reinforcing panel that is hingedly connected to said edge flap; and a second edge flap reinforcing panel that is hingedly connected to said first edge flap reinforcing panel;

wherein a reinforcing edge of each of said first and second edge flap reinforcing panels is disposed in reinforcing proximity to said handle opening so as to reinforce at least a weight bearing edge of said handle opening, wherein said multiple walls of said tubular structure comprising: a top wall; a bottom wall; and first and second side walls, and wherein the edge flap is hingedly connected to the top wall and secured in flat face contact with one of said first and said second side walls.

2. The carton of claim 1, wherein said at least one end closure further comprises a top end flap hingedly connected to said top wall, said top end flap including said handle opening, said handle opening being defined by an endless edge.

3. The carton of claim 2, said at least one end closure further comprising a side end flap hingedly connected to each of the first and second side walls, each side end flap comprising a cutout having dimensions complementary to the dimensions of at least part of said handle opening; and wherein said top end flap is foldable to at least partially overlie said side end flaps so that said handle opening in said top end flap is in registry with said cutouts in said first and second side end flaps.

4. The carton of claim 3, wherein at least one of said side end flaps comprises a side flap reinforcing panel hingedly connected thereto, said side flap reinforcing panel being folded into a face contacting arrangement with said at least one said side end flap.

5. The carton of claim 4, wherein one of said first and second edge flap reinforcing panels are coplanar with said side flap reinforcing panel such that each provide a portion of a single layer of reinforcement to at least said weight bearing edge of said handle opening.

6. The carton of claim 2, wherein the reinforcing edge of each of said first and second edge flap reinforcing panels is substantially aligned with a portion of a periphery of said handle opening.

7. The carton of claim 6, wherein the first edge flap reinforcing panel has a pair of upper and lower opposed edges, the lower edge comprises the reinforcing edge of the first edge flap reinforcing panel, and the first edge flap reinforcing g panel is connected along the upper edge thereof to the second edge flap reinforcing panel.

8. The carton of claim 7, wherein the second edge reinforcing panel extends downward from the upper edge of the first edge flap reinforcing panel and terminates in a lower edge of the second edge flap reinforcing panel, the lower edge of the second edge flap reinforcing panel being the reinforcing edge of the second edge flap reinforcing panel.

9. The carton of claim 1, wherein the second edge flap reinforcing panel is disposed in a face contacting arrangement with the first edge flap reinforcing panel.

10. A blank for forming a carton, comprising:

a plurality of primary panels hingedly connected in series, the primary panels including a pair of endmost panels;

an edge flap hingedly connected to one of the endmost panels to be secured to the other endmost panel to form the primary panels into a tubular structure;

a first edge flap reinforcing panel hingedly connected to said edge flap;

a second edge flap reinforcing panel hingedly connected to said first edge flap reinforcing panel; and a plurality of end flaps for forming an end closure at one end of said carton, each of said plurality of end flaps being hingedly connected to the corresponding end edge of one of said primary panels, said end flaps for forming an end closure, wherein at least one of said plurality of end flaps includes a feature for defining a handle opening disposed through said end closure;

wherein a reinforcing edge of each of said first and second edge flap reinforcing panels is positioned and dimensioned for being disposed in reinforcing proximity to said handle opening so as to reinforce at least a weight bearing edge of said handle opening when said end closure is formed.

11. The blank of claim 10, wherein the reinforcing edge of the second edge flap reinforcing panel abuts said at least one of said plurality of end flaps.

12. A carton, comprising:

a tubular structure comprising a top wall, a bottom wall, a first side wall, and a second side wall;

an edge flap that is hingedly connected to the top wall and secured in flat face contact with one of said first side wall and said second side wall; and at least one end closure, comprising:

a top end flap comprising a handle opening, the top end flap being hingedly connected to the top wall, said handle opening being defined by an endless edge; and a first edge flap reinforcing panel being hingedly connected to said edge flap, wherein a reinforcing edge of said edge flap reinforcing panel is substantially aligned with a portion of a periphery of said handle opening so as to reinforce at least a weight bearing edge of said handle opening, wherein said at least one end closure further comprises a second edge flap reinforcing panel hingedly connected to the first edge flap reinforcing panel.

13. The carton of claim 12, wherein said at least one end closure further comprises a side end flap hingedly connected to each of the first side wall and the second side wall, each side end flap comprising a cutout with a reinforcing edge that is configured to reinforce at least a part of the weight bearing edge of the handle opening.

14. The carton of claim 12, wherein the first edge flap reinforcing panel has a pair of upper and lower opposed edges, the lower edge comprises the reinforcing edge, and the first edge flap reinforcing panel is connected along the upper edge thereof to the second edge flap reinforcing panel.

15. The carton of claim 12, wherein the second edge flap reinforcing panel is disposed in a face contacting arrangement with the first edge flap reinforcing panel.

16. The carton of claim 12, wherein the first edge flap reinforcing panel is disposed in face a contacting arrangement with an inside surface of one of the side end flaps.

17. The carton of claim 16, wherein a side flap reinforcing panel is hingedly connected to the other side end flap and is folded such that the side end flap reinforcing panel is disposed in a face contacting arrangement with an inside surface of the other side end flap.

18. The carton of claim 12 wherein a reinforcing edge of said second edge flap reinforcing panel is substantially aligned with a portion of the periphery of said handle opening.

19. The carton of claim 12, wherein the second edge flap reinforcing panel is disposed in a face contacting arrangement with the first edge flap reinforcing panel.

* * * * *